United States Patent [19]

Cutler et al.

[11] Patent Number: 4,748,296

[45] Date of Patent: May 31, 1988

[54] PUSH-TO-START CONTROL SWITCH

[75] Inventors: Leon H. Cutler, Stratford, Conn.; Warren B. Bigelow, Jr., Shelby, N.C.

[73] Assignee: General Electric Company, Bridgeport, Conn.

[21] Appl. No.: 937,328

[22] Filed: Dec. 3, 1986

[51] Int. Cl.[4] ..... H01H 19/14

[52] U.S. Cl. ..... 200/6 B; 200/38 A

[58] Field of Search ..... 200/6 B, 38 A, 38 R, 200/160; 307/141

[56] References Cited

U.S. PATENT DOCUMENTS

| | | | |
|---|---|---|---|
| 2,203,224 | 4/1939 | Kimball | 200/6 BB |
| 3,160,719 | 12/1964 | Seidel | 200/38 R |
| 3,198,893 | 8/1965 | Mapelsden | 200/6 B |
| 3,201,564 | 8/1965 | Hutt | 219/398 |
| 4,146,760 | 3/1979 | Voland | 200/38 A |

OTHER PUBLICATIONS

Mathewson et al., "Momentary Contact Actuator," IBM Tech. Disclosure Bulletin, vol. 15, No. 10, 3/73-pp. 3162-3163.

*Primary Examiner*—A. D. Pellinen
*Assistant Examiner*—Morris Ginsburg
*Attorney, Agent, or Firm*—Hedman, Gibson, Costigan & Hoare

[57] ABSTRACT

An electrical switch for an appliance which includes a push-to-start control switch for starting a motor operation. The switch comprises a housing, a covering for the housing, a rotatable non-conductive cam positioned within the housing having a set of annular cam tracks thereon for controlling an appliance.

5 Claims, 2 Drawing Sheets

PUSH-TO-START CONTROL SWITCH

BACKGROUND OF THE INVENTION

This invention is directed to single rotary switches for laundry applications and, more particularly, to a single rotary switch with normal circuit switching in combination with a push-to-start feature for starting a motor.

Heretofore, home laundry machines, particularly clothes dryers, have used a single rotary switch for selecting the proper first heat level for drying cotton clothes, a second heat level for permanent press clothes, a third heat level for fluffing, etc. These dryers may also include a rotary knob activated timer for initiating operation of the dryer for certain time periods depending on the degree of rotation for the different selected periods and types of drying. In addition, in conventional prior art dryers, a separate motor starter switch may be, among others, a push button switch, a toggle switch, or a rotatable switch.

In normal prior art operation, the switch for the type (i.e., temperature) of drying is set at a selected position, the timer is set, then the separate starter motor switch is activated. Once the motor starter switch is activated, the motor starts operating.

Once the motor is rotating, a centrifugal switch within the motor functions to complete the circuit to the power source and the motor will continue to operate. A heat safety switch is usually placed in the power source and routed through the centrifugal switch to inactivate the power source if a heat problem arises. In addition, there is usually a switch controlled by the door, which switch will open the power circuit if the door is opened.

SUMMARY OF THE INVENTION

The switch of the present invention utilizes in part a prior art switch previously used in home laundry appliances such as clothes dryers and combines this well known switch with a push-to-start motor actuator switch. The prior art switch operates to a restricted degree in the prior art manner. However, it also incorporates and combines in the same switch a push-to-start action as a feature.

OBJECTS OF THE INVENTION

It is an object of this invention to provide a rotary selector switch which combines and includes also a push-to-start feature.

Another object is to provide a rotary selector switch incorporating a push-to-start feature which does not detract from the operation of the rotary selector switch.

Still another object is to provide a laundry control switch in which the operation of the selector and motor starter switches are combined to operate at one control location by a single manual manipulator.

DETAILED DESCRIPTION OF THE INVENTION

Figure 1:
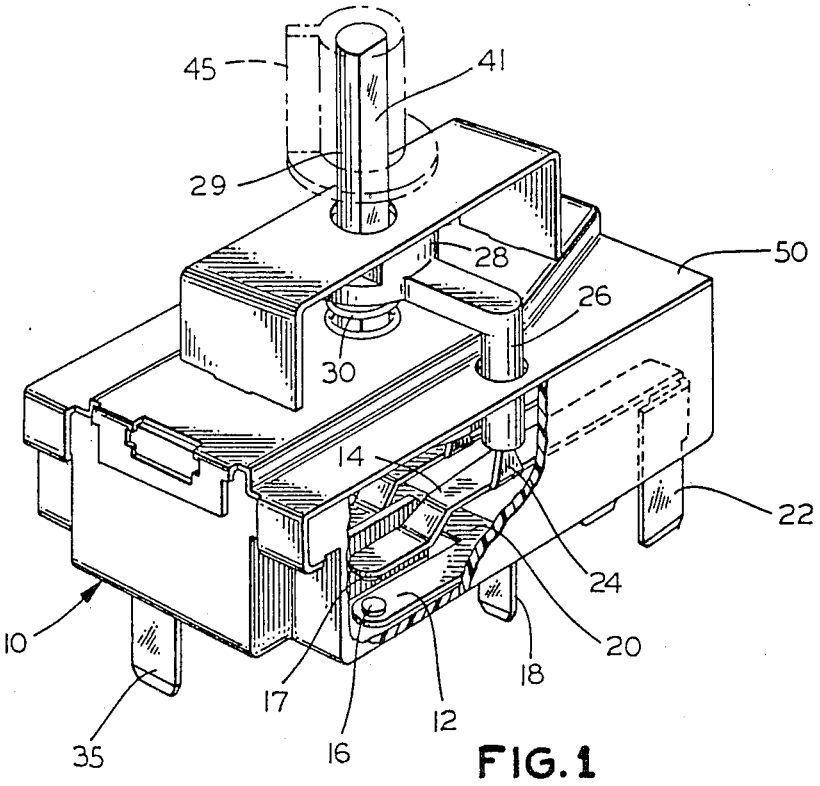
FIG. 1 is an isometric side view of the switch mechanism of the present invention having a cutaway section which illustrates the portion of the mechanism which provides push-to-start action.

Referring now to the drawings, there is shown a combination selector control switch which incorporates a push-to-start motor control feature. FIG. 1 illustrates the switch 10 in an isometric view having a cutaway on one side to show the combined elements of the push-to-start switch housing. The switch housing includes a cover 50 having a rotary switch shaft 29 extending therethrough. As shown, the push-to-start portion of the switch 10 includes a stationary conductive strip 12 and a moveable-spring type conductive strip 14. Each of the conductive strips 12 and 14 is provided with a respective switch contact 16 and 17 at one end thereof. These contacts oppose each other and make contact with each other to complete an electrical circuit through the conductive strips to the starting winding of a motor. The fixed stationary conductive strip 12 is electrically connected to the power source by a male prong 18. When actuated, the push-to-start switch completes the circuit to the motor through male prong 22 which is electrically connected (as shown in phantom) to the spring conductive strip 14. The spring conductive strip 14 has been shown partially in dotted line (i.e., in phantom) to illustrate the electrical connection with the male prong 22. Accordingly, the push-to-start switch is effective when actuated to provide electrical connection from prong 18 to prong 22 through the stationary and movable switch elements 12, 14, 16 and 17.

Figure 6:
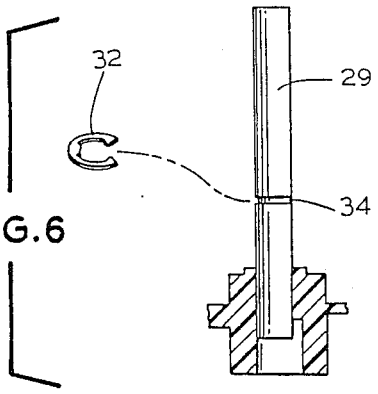
FIG. 6 is an elevational view of the switch shaft and a locking "E" ring which is mounted thereon.
Figure 5:
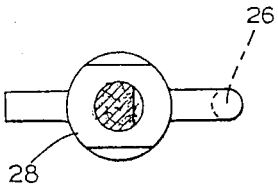
FIG. 5 is a plan view of one component of the push-to-start switch actuating device taken along a line 5—5 of FIG. 3B.

The spring conductive strip 14 is provided with an upstanding portion 24 which is engaged by a control arm 26. Arm 26 is made of plastic or any other insulator material in order to momentarily push the conductive strip 14 toward the fixed conductive strip 12 to make contact between the contacts 16 and 17. The arm 26 extends from a body portion 28 which loosely surrounds the switch shaft 29 and is not rotatable by the switch shaft. In order to maintain the push-to-start switch in a normally open position, a spring 30 is positioned between the switch cover 50 and the control arm body 28 to urge the body to an upper position at rest position. The control arm body 28 is limited in its upward movement on the switch shaft 29 by use of a locking "E" ring 32 which slides into a groove 34 on the shaft, as shown in FIG. 6. Thus, the shaft 29 is freely rotatable relative to the control arm body 28 and the control arm body 28 is free to be moved in an axial direction along the shaft below the "E" ring 32 in order to close and open the push-to-start switch. Manual axial force applied against knob 45 by an operator is required to close the push-to-start switch by overcoming the spring force of the return spring 30. Spring 30 forces the push-to-start switch open once the knob 45 is released by the operator.

Figure 2:
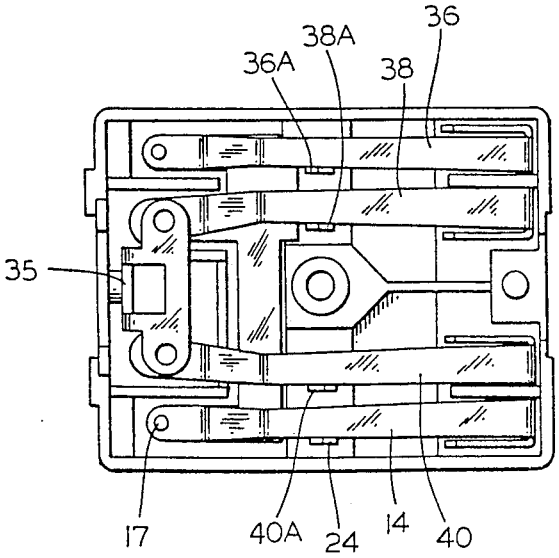
FIG. 2 is a top plan view of the portion of the control mechanism and particularly the array of electrical conductor strips for making and breaking the various control circuits of the switch shown in FIG. 1, but with the cover, subassembly cam and detent springs omitted to provide an interior view of the switch base and its contents.

Additional depending male elements such as 35 (see FIG. 1) are provided to interconnect the control switch in a conventional manner for control of selected heater elements during heating at different temperature levels. FIG. 2 illustrates the interior of the bottom of the switch and illustrates some of the multiple stationary and movable strip conductors. One combination of a wide variety of such conductors is shown in FIGS. 2 and 3 as conductors 36, 38 and 40, with upstanding tabs 36A, 38A and 40A respectively, which are engaged for electrical operation by the tracks of cam 42.

Figure 3A:
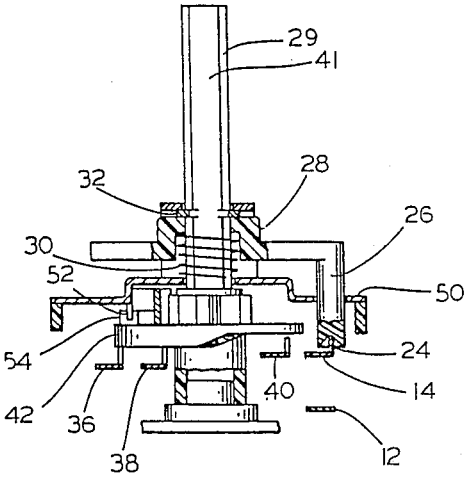
FIG. 3A is a cross-sectional view illustrating a cam, certain switch elements, and the push-to-start switch in combination.
Figure 3B:
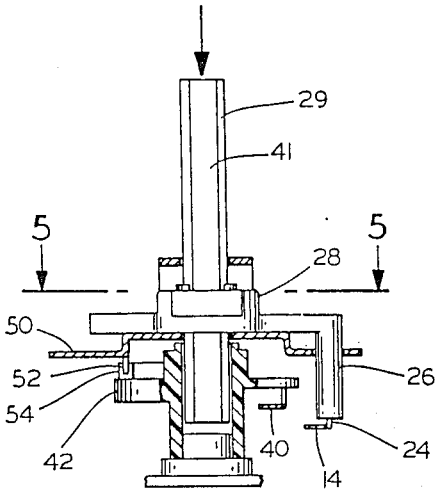
FIG. 3B is a view similar to that of 3A but with the shaft and related elements in a depressed position.

FIG. 3A illustrates the positional relationship of the push-to-start switch control arm 26, body 28, spring 30 and the locking "E" ring 32 mounted in shaft 29. FIG. 3A also illustrates cam 42 which may be rotated by the shaft 29 to one of a number of selected positions. The shaft has a flat side 41 which mates with a like surface of cam 42 and a control position knob 45 (see FIG. 1) in order to rotate the cam.

Figure 4:
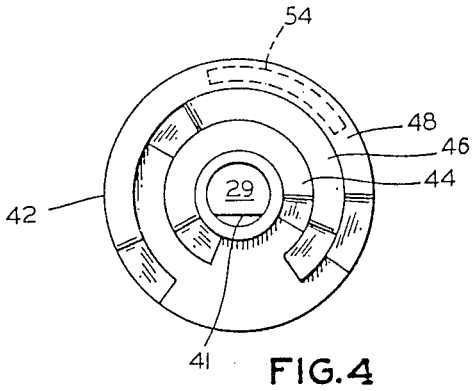
FIG. 4 is a plan view of a non-conductive switch cam, which makes mechanical wiping contact with certain of the conductive spring contacts of FIG. 2 to urge them into a number of different sets of positions.

The cam 42 is formed of a shaped non-conductive material so that the surface thereof, in a horizontal plane, constitutes the tracks 44, 46 and 48 (see FIG. 4). The non-conductive material is formed in a set pattern as shown in FIG. 4 so that selected movement will be made of spring arms to complete selected electrical circuit through selected controlled elements such as different heater elements. In conventional clothes dryers, the rotary switch controls the selection and sequential switching of different heater elements so that different heater supplies are activated. Accordingly, this switch operates in the conventional manner to provide different heating levels for different selected positions of the switch. The heat selection positions are conventional and operate simultaneously with and in cooperation with the push-to-start switch. However, the push-to-start switch is separate and not controlled by the cam. The cam controls the heat levels as previously described. There is cooperation between the cammed rotary switch and the push-to-start switch, but there is no interference between the push-to-start switch and the cammed switches although operated by a single knob actuator. The structure and mode of operation of the cammed switches are described in United States Letters Pat. Nos. 2,203,224 to D. Kimball; 3,201,564 to P. Hatt and 3,198,893 to Maplesden, which are incorporated herein by reference.

It is to be noted that the switch shaft 29 which is rotated by the knob 45, rotates the cam to a particular set position and that the push-to-start switch control arm 26 does not rotate as knob 45 is rotated, but remains in a set position. The control arm 26 is held against rotation by the switch body cover 50 through which the control arm 26 extends. Therefore, it is obvious that the cam can be set at any position without changing the position of the push-to-start control arm. The selector switch shaft is provided with a pointer control knob 45 for showing the position of the rotary cammed switch and to aid in rotation of the rotary cammed switch. As shown in FIG. 3, the rotary switch cover may be provided with a cam stop 52 which extends downwardly to prevent the cam from rotating through 360° by contact with a portion 54 on the cam. As shown, the cam can be rotated in each direction and will be stopped by either end of the cam portion 54 by contacting the cam stop 52. The stop 52 can be omitted for 360° rotation, if desired.

In operation, for a home clothes dryer, the selector switch 10 is moved to the desired angular or rotary position for the type of clothes to be dried. Such position and clothes type is designated on the dryer or on a stationary part of the switch. During rotation of the switch shaft, the cam is simultaneously rotated, thereby causing the switch contacts to make contact with the designated conductive surface of the cam for the selected position. The timer is set for the designated time of operation for the selected position of the selector switch. The selector switch shaft is then moved downwardly or inwardly causing the locking "E" ring to force the body 28 of the control arm to simultaneously move the control arm downwardly against the force of the spring 30. The control arm 26 contacts the conductive spring switch element 14 to move the spring switch element 14 into contact with the fixed conductive strip 12. When conductive spring element 14 contacts fixed conductive strip 12, an electrical circuit is completed to the motor, thus causing the motor to start.

Once the motor has started, the selector switch shaft is released and the spring 30 then forces the control arm 26 upwardly or outwardly to its normal at rest position. This return outward movement breaks contact between switch elements 12 and 14.

Immediately upon contact between the push-to-start switch elements, the motor starts to rotate. After reaching a certain rotational speed, a centrifugal switch in the motor makes a circuit in parallel with the circuit of the push-to-start switch maintaining the motor in the on position. The motor circuit may also be maintained by an electrical relay in case the knob 45 has been maintained in a depressed position. As the motor gains rotational speed, the centrifugal switch closes additional switch contacts in the motor which control the power source to elements of the rotary selector control switch. Current flow through these selected elements controls the heat level according to the planned operation as dictated by the position of the rotary selector switch. The current flowing through these elements is also directed through the conductive elements of a timer so that the motor and heating cycle will be discontinued at the end of the designated time when the conductive elements of the timer are separated.

A selector switch as set forth above could be used on a washing machine to select different wash speeds and/or spin speeds as well as for solenoid controls for switching the mechanical operations for different agitation and spin speeds.

The combination selector and push-to-start switch of this invention provides a structure in which two operations may be completed at one operator position and by use of only one switch element.

The foregoing relates to a preferred exemplary embodiment of the invention, it being understood that other embodiments and variants thereof are possible within the spirit and scope of the invention, the latter being defined by the appended claims.

We claim:

1. A combination electrical selector push-to-start switch, comprising:

a housing, a covering for said housing, a rotatable non-conductive cam positioned within said housing having a set of annular cam tracks thereon for controlling an applicance;

a rotatable shaft attached to said rotatable cam for rotation thereby;

a plurality of electrical switch contacts positioned within said housing in close proximity to said cam for completing an electrical circuit according to the position of said set of annular cam tracks relative to said switch contacts;

a push-to-start switch means mounted within said housing, including a fixed conductive strip and a spring conductive strip positioned relative to said fixed conductive strip in a normally open position, each of said conductive strips of said push-to-start switch means including opposing contacts thereon which are forced together to close said electrical circuit to a starting winding of a motor; and means for temporarily forcing said spring conductive strip into electrical contact with said fixed conductive strip to close an electrical circuit to a starting winding of an electrically operated motor of an appliance, said means for temporarily forcing said spring conductive strip into electrical contact with said contact on said fixed conductive strip being a control arm of insulating material supported by said rotatable shaft which contacts said spring conductive strip.

2. The combination switch of claim 1, wherein said control arm of insulating material is attached to a body portion that surrounds said rotatable shaft in a fixed relationship so that said rotatable shaft rotates freely relative to said fixed body portion.

3. The combination switch of claim 2, further comprising:

a spring means surrounding said shaft and positioned relative to said body portion so that said body portion and said control arm are forced in a direction away from said fixed conductive strip so as to maintain said push-to-start switch means in a normally open position.

4. The combination switch of claim 3, wherein a locking "E" ring is attached to said rotatable shaft to maintain said body portion against said spring means to make contact between said conductive strips.

5. The combination switch of claim 3, wherein said control arm is held against rotation by said housing cover.

* * * * *